United States Patent [19]

Kelly

[11] Patent Number: 4,991,774

[45] Date of Patent: Feb. 12, 1991

[54] ELECTROSTATIC INJECTOR USING VAPOR AND MIST INSULATION

[75] Inventor: Arnold J. Kelly, Princeton Junction, N.J.

[73] Assignee: Charged Injection Corporation, Princeton Junction, N.J.

[21] Appl. No.: 398,151

[22] Filed: Aug. 24, 1989

[51] Int. Cl.[5] ..... B05B 5/025

[52] U.S. Cl. ..... 239/3; 239/13; 239/136; 239/696; 239/708

[58] Field of Search ..... 239/3, 13, 290, 291, 239/102.2, 136, 690, 696, 691, 708

[56] References Cited

U.S. PATENT DOCUMENTS

| | | | |
|---|---|---|---|
| 4,106,697 | 8/1978 | Sickles et al. | 239/291 |
| 4,255,777 | 3/1981 | Kelly | 239/704 |
| 4,296,003 | 10/1981 | Harrold et al. | 252/571 |
| 4,440,971 | 4/1984 | Harrold | 252/571 |
| 4,508,265 | 4/1985 | Jido | 239/708 |
| 4,605,485 | 8/1986 | Cerkanowicz | 204/302 |
| 4,630,169 | 12/1986 | Kelly | 239/690 |

*Primary Examiner*—Andres Kashnikow
*Assistant Examiner*—Karen B. Merritt
*Attorney, Agent, or Firm*—Lerner, David, Littenberg, Krumholz & Mentlik

[57] ABSTRACT

In electrostatic atomization of liquids wherein a stream of electrically charged liquid is atomized under the influence of the electrical charge, the stream is surrounded by a mist to increase the dielectric breakdown strength of the surrounding atmosphere. This permits use of higher charge levels and hence more efficient atomization. The mist may incorporate minute droplets of the liquid to be atomized. An insulating vapor may be formed from the liquid by heating a portion of the liquid and employed in place of or in addition to the mist.

25 Claims, 3 Drawing Sheets

ELECTROSTATIC INJECTOR USING VAPOR AND MIST INSULATION

FIELD OF THE INVENTION

This invention relates to the electrostatic atomization of liquids.

BACKGROUND OF THE INVENTION

Atomization of a liquid is a process whereby the liquid is broken up and dispersed into fine droplets. Atomization is currently used in many industrial processes such as in operation of combustion engines, in liquid drying and in spray painting. One method of atomizing a liquid is accomplished by injecting a net electrostatic charge into the liquid and then passing the charged liquid through a small orifice to form a stream. Because the individual portions of the liquid each bear the same charge, small charged droplets of the liquid will form and repel from one another due to the principle of mutual repulsion of like charges. It is generally desirable in the field of electrostatic atomization to produce more finely atomized liquid droplets. To create finer droplets of liquid, the charge density of the liquid stream must be increased.

U.S. Pat. No. 4,255,777 discloses an electrostatic atomizing device which can apply substantial net charges to the liquid and which can generate fine droplets. It is possible to increase the net charge applied by the apparatus of the '777 patent so as to form finer droplets. However, when the charge on the liquid is increased to extremely high levels, the atmosphere surrounding the charged liquid may become electrically unstable and corona discharge may occur. Thus, as one increases the net charge on the stream to generate a more finely atomized liquid, the more susceptible the surrounding atmosphere becomes to corona discharge. Such corona discharge can dissipate the charge applied to the liquid, thus impeding atomization.

U.S. Pat. No. 4,605,485 discloses another electrostatic atomizing device which utilizes a blanket of gas such as sulfur hexafluoride having a high dielectric strength under pressure to surround the stream of charged liquid. This blanket of gas prevents corona discharge at relatively high charge levels.

In the apparatus of U.S. Pat. No. 4,630,169, the liquid to be charged and atomized is mixed with a high vapor pressure hydrocarbon or a halogenated component supplied through a separate line. The mixture of components is then charged and projected through the orifice. As this mixture issues as a stream through the orifice, the high vapor pressure component vaporizes and forms a gas blanket around the stream. In this apparatus as well, the gas blanket retards corona breakdown of the surrounding atmosphere.

Use of these gaseous "blankets" in the vicinity of the charged stream is helpful but limiting in that it is necessary to supply a gas or high vapor pressure component in addition to the liquid to be atomized. The extraneous gas or high vapor pressure component is objectionable in many systems.

A technique referred to as "vapor mist" insulation has been used in the unrelated art of high voltage electrical equipment. In U.S. Pat. No. 4,440,971, a sealed chamber containing high voltage electrical equipment such as a power transformer is filled with a dielectric gas supersaturated with the vapor of a dielectric liquid. The supersaturated mixture provides a high dielectric strength medium and thus retards corona discharge. In U.S. Pat. No. 4,296,003, another reference directed to high voltage electric power equipment, a sealed chamber surrounding the equipment is filled with a dielectric composition comprising a mixture of two liquids. The first liquid is selected from the group of electronegative gases (such as $SF_6$ or $F_2$) or the group of electropositive gases (such as $N_2$ or $CO_2$) or a mixture thereof. The second liquid is selected from a group of atomized liquids such as chlorinated liquids or fluorocarbon liquids or a mixture thereof. The droplets formed in such a mixture serve to enhance the dielectric strength of the gas. Neither of the above electric power references is directed to improvements in electrostatic atomization systems.

Despite efforts in the field of electrostatic atomizing devices, the promise of electrostatic atomization has not yet been fully realized due to performance limitations relating to corona discharge. Thus, there has been a long-felt need for electrostatic atomization apparatus and methods which mitigate or avoid the corona discharge problem and thus provide superior atomization of a liquid. In particular, there are needs for methods and apparatus which provide this improvement without requiring the use of additional gases or component mixtures.

SUMMARY OF THE INVENTION

The instant invention addresses those needs.

One aspect of the instant invention provides a method of atomizing a liquid. The method according to this aspect of this invention includes the steps of supplying a liquid, introducing a net charge into the liquid so that the liquid is atomized at least partially under the influence of the net charge, and supplying an insulating mist in juxtaposition with the charged liquid so as to insulate the charged liquid from the surroundings prior to the atomization. Thus, when the liquid is issued from an orifice as a stream, the insulating mist may surround the stream to the point where the stream breaks into droplets. Most preferably, the insulating mist is formed by atomizing a small portion of the principal liquid to be atomized.

Another aspect of the instant invention provides apparatus for atomizing a liquid. The apparatus desirably includes means for supplying a liquid, means for inducing a net charge on the liquid so that the liquid is atomized at least partially under the influence of the net charge, and means for supplying an insulating mist in juxtaposition with the charged liquid so as to insulate the charged liquid from the surroundings prior to the atomization. Preferably, the means for supplying the insulating mist includes means for forming the insulating mist from a portion of the liquid supplied by the means for supplying liquid to be atomized.

In the preferred apparatus and methods according to the invention, the mist provides a high dielectric breakdown strength in the region surrounding the charged liquid, and hence suppresses corona discharge. Where the insulating mist is formed from the same liquid which is charged and atomized, the charged liquid is electrically insulated from the surroundings without the necessity of supplying a second liquid or gas as practiced in the prior art.

The means for supplying the insulating mist may include means for heating a portion of the liquid to thereby vaporize the heated portion and form droplets by condensation. The heating means may include a porous insulating element for absorbing the supplied liquid in juxtaposition with an electrical resistance element for heating the liquid thereby generating the insulating vapor mist. Alternatively, the insulating mist may be formed by ultrasonic atomization or by other atomizing techniques.

In methods and apparatus according to further aspects of this invention, a portion of the liquid to be atomized is heated to form a vapor, and the resulting vapor is juxtaposed with the charged liquid so that the vapor insulates the charged liquid from the surroundings. That portion of the liquid to be converted to vapor may be separated from the principal liquid stream and directed to a heating element.

In methods according to this aspect of the invention, the vapor itself serves as an insulator. The dielectric breakdown strength of a vapor generally is less than that of a mist incorporating the same components. Nonetheless, the vapors of common liquids such as hydrocarbon can provide dielectric breakdown strength significantly greater than that of air or other common gasses. Accordingly, methods and apparatus according to this aspect of the invention can provide adequate corona resistance in many applications. Because the vapor is derived from the liquid itself, there is no need for extraneous gasses or high vapor pressure additives.

The present invention can be further understood with reference to the description and drawings.

DETAILED DESCRIPTION OF THE PREFERRED EMBODIMENTS

Figure 1:
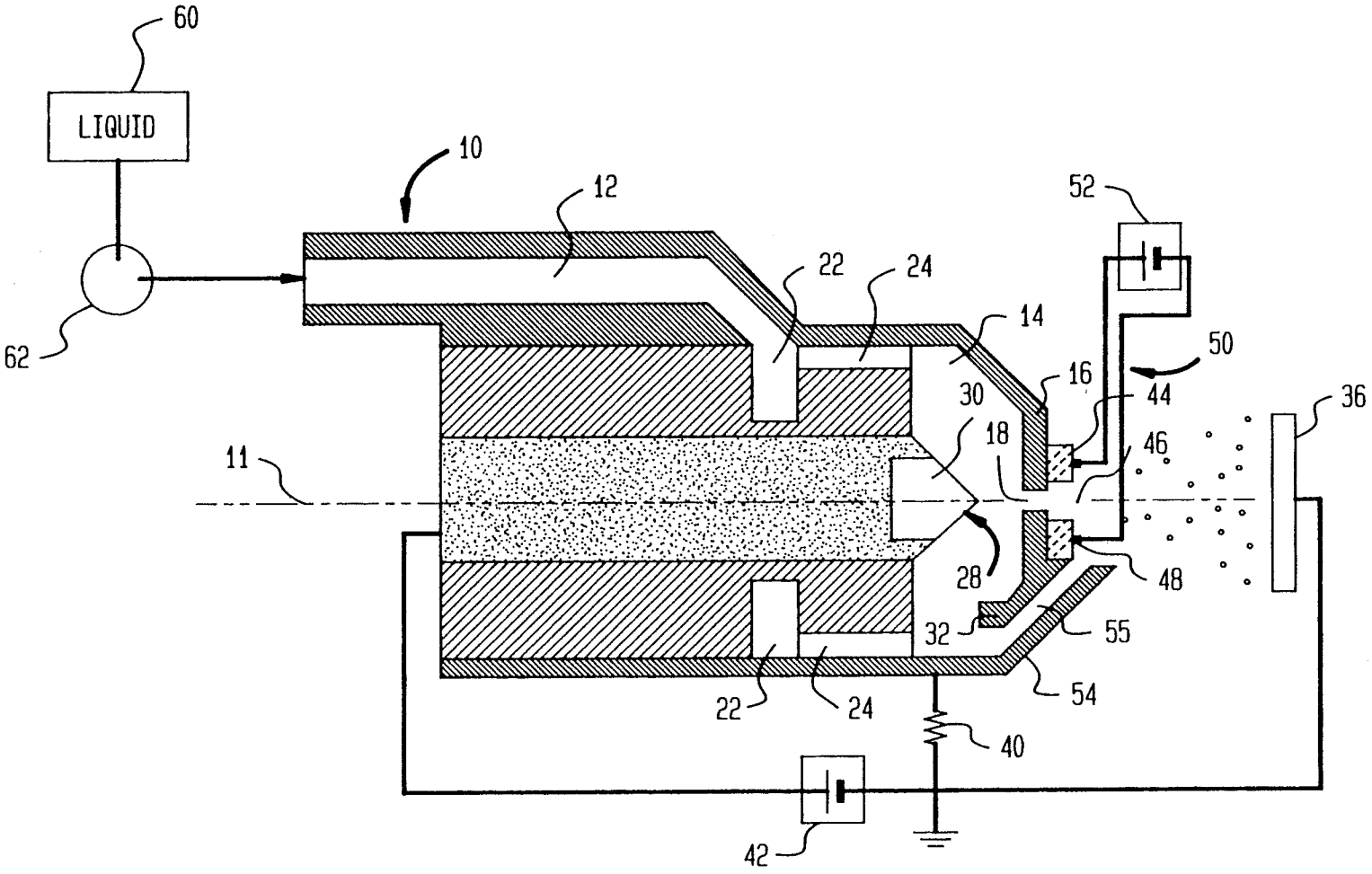
FIG. 1 is a diagrammatic sectional view of atomization apparatus in accordance with one embodiment of the invention.

Apparatus in accordance with a first embodiment includes a generally cylindrical electrically conductive metallic body 10 having a central axis 11. Body 10 has a liquid supply line 12 formed therein and opening to a central chamber 14. Body 10 defines a forward wall 16 having an orifice 18 opening therethrough on central axis 11. An electrically insulating support 20 is disposed within the central chamber 14 of body 10. Insulator 20 is generally cylindrical and coaxial with body 10. The insulator defines a plurality of liquid distribution channels 22 extending generally radially and a set of axially extensive grooves 24 adjacent the outer periphery of the insulator. Radial channels 22 merge with one another adjacent the central axis 11 of the insulator and body and merge with the grooves 24. Further, the radial channels 22 and axial grooves 24 communicate with the inlet passage 12 of body 10, so that the inlet passage is in communication, via the radial channels 22, with all the axial grooves 24 around the periphery of insulator 20. Insulator 20 may be formed of any substantially rigid dielectric material, such as a glass, non-glass ceramic, thermoplastic polymer or thermosetting polymer.

A central electrode 26 is mounted within insulator 20 and electrically insulated from the body 10 by insulator 20. Central electrode 26 has a pointed forward end 28 disposed in alignment with orifice 18 and in close proximity thereto. The forward tip 28 of central electrode 26 is formed from a fibrous material having electrically conductive fibers 30 extending generally in the axial direction of the electrode and of body 10, each such fiber 30 having a microscopic point, these points cooperatively constituting the surface of tip 28. The interior surface of forward wall 16 constitutes an intermediate electrode 32 surrounding orifice 18. A ground electrode 36 is mounted remote from body 10 and remote from orifice 18. Although electrode 36 is schematically illustrated as a flat plate in FIG. 1, its geometrical form is not critical. Where the atomized liquid is directed into a vessel, pipe or other enclosure, the ground electrode may be a wall of the enclosure.

Ground electrode 36 is at a reference or ground electrical potential. The body 10, and hence intermediate electrode 32, is connected via a resistor 40 to the ground potential. Tip 28 of central electrode 26 is connected to a high voltage potential source 42. The foregoing components of the apparatus may be generally similar to the corresponding components of the apparatus illustrated in United States Pat. No. 4,255,777, the disclosure of which is hereby incorporated by reference herein.

A porous ring 44 of a fibrous material such as paper or a porous ceramic is disposed on the front surface of frontal wall 16. Ring 44 defines an opening 46 somewhat larger than the opening of orifice 18 and aligned therewith. An electrical resistance heating wire 48 formed from a conductive metal resistant to thermal degradation such as nickel chromium alloy extends along the front or exposed surface of ring 44. Wire 48 is connected via leads 50 to an electrical power source 52. A small passageway 54 extends through the wall of body 10, from central chamber 14 to an opening 55 adjacent the periphery of ring 44.

Figure 2:
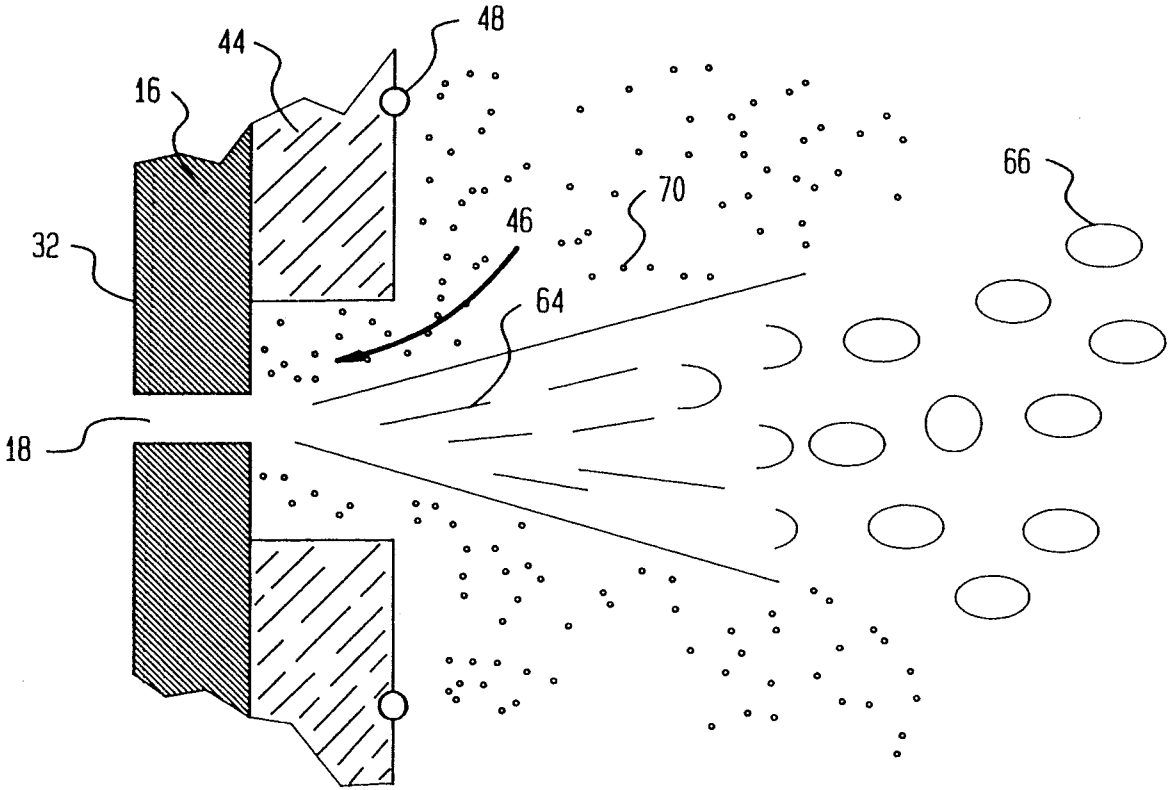
FIG. 2 is a fragmentary, diagrammatic view of a portion of the apparatus shown in FIG. 1, on an enlarged scale.

In a method of atomization according to one embodiment of the invention, a reservoir 60 containing the liquid to be atomized is connected via a conventional pump 62 and conventional flow-regulating components such as valves, pressure regulators and the like (not shown) to the supply conduit 12. Liquid from reservoir 60 passes through supply conduit 12 and via radial conduits 22 and axial grooves 24 into the central chamber 14. The major portion of the liquid entering the chamber flows from the periphery of the chamber to orifice 18 under the pressure applied by pump 62. Thus, the major portion of the liquid is discharged through orifice 18 as a stream 64 (FIG. 2), the stream being directed in downstream direction from the orificer, towards the right.

Potential source 42 is actuated so as to apply a substantial potential, typically about 10 Kilovolts or more to the tip 28 of central electrode 26 relative to the ground or reference potential. Under these conditions, electric charges pass from tip 28 into the liquid in central chamber 14 and towards intermediate electrode 32. Injection of charge into the liquid is promoted by the numerous small points 30 constituting the surface of tip 28. As the mobility of electrical charges in the liquid is limited, and as the liquid has a substantial velocity through the chamber, the majority of the charges do not reach electrode 32 before the liquid passes from the chamber through orifice 18. Thus, electrode 32 remains at a relatively low potential, close to the ground or reference potential. The major portion of the electrical charge passing into the liquid in chamber 14 remains in the liquid as the liquid exits through orifice 18. Accordingly, the stream of liquid 64 exiting from the orifice bears a net charge. Under these conditions, the stream 64 is atomized to form droplets 66. The atomization results in major part from the action of the charge in the liquid stream 64. These aspects of the operation are generally similar to operation of the atomizing device described in the aforementioned U.S. Pat. No. 4,255,777.

A minor portion of the liquid passing through chamber 14 exits from the chamber via passageway 54. The liquid exiting through passageway 54 is taken up by the porous ring 44. Power source 52 actuates heating wire 48 so that the wire 48 reaches a temperature approximately equal to the boiling point of the liquid. Liquid within porous ring 44 in proximity to wire 48 is thus heated and vaporized. The vapor resulting from this heating step blends with the atmosphere surrounding the atomization device and passes away from the vicinity of wire 48 under the influence of convection currents and gas currents caused by the action of stream 64. In particular, stream 64 tends to entrain gasses, thus causing a generally centrally-directed flow of gasses from the surroundings toward the stream. As the vapors move away from the vicinity of wire 48, toward the stream, the vapors cool, condense and form a mist of fine droplets 70 surrounding stream 64 in the region immediately downstream from orifice 18. Thus, the region of space surrounding stream 64 in the region immediately downstream from orifice 18 is filled with a mist or dispersion of liquid droplets 70 in gas incorporating a mixture of the vapor and the gas constituting the surrounding atmosphere. This mist electrically insulates stream 64 from the surrounding atmosphere, i.e., from that portion of the surrounding atmosphere beyond the mist. The mist or dispersion of droplets 70 in the gas has a substantially higher dielectric strength than the atmospheric gas itself. Therefore, the surrounding mist 70 effectively prevents corona discharge in the atmosphere around stream 64. While the liquid is in stream 64, and before it is atomized to form droplets 66, the liquid is electrically isolated from the surroundings by the mist of droplets 70. In the downstream region, remote from forward wall 16, the mist droplets 70 merge with and are entrained in the larger droplets 66 derived from atomization of the liquid in stream 64.

Desirably, the mist 70 is maintained over substantially the entire distance from the orifice to the point along the stream where the stream breaks into droplets 66. Downstream of the point where the stream is substantially atomized into droplets 66, corona discharge ceases to be a problem and hence there is no need to surround the droplets 66 with a mist of droplets 70 downstream beyond this point. For typical atomizing systems operating at a Reynolds numbers of about 100 to about 10,000, based upon the diameter of the orifice 18 and the flow rate of the liquid through the orifice the stream generally breaks into droplets at about 1 to about 100 orifice diameters downstream from the orifice. Thus, for typical systems processing liquids having viscosities of about 1 to about 1,000 centipoise, and using an orifice 18 having an internal diameter of several hundred micrometers, stream 64 typically breaks into droplet 66 at a distance of about 2 cm. or less, and usually about 1 cm. or less downstream from orifice 18. Accordingly, in these systems it is desirable to maintain the mist 70 over a distance of at least about 1 cm., and preferably about 2 cm. downstream from orifice 18. The concentration of droplets in this region should be effective to increase the dielectric breakdown strength of the gas within the region by at least about 2 megavolts/meter, and desirably at least about 8 megavolts/meter. The concentration of mist droplets in the gas required to achieve these levels will depend in part upon the particular liquid constituting the mist droplets and in part upon the surrounding gas into which the droplets are dispersed to form the mist. In the most typical case where the surrounding gas is air and the mist droplets are formed from a hydrocarbon liquid, the mist desirably includes at least about $10^5$ droplets per $cm^3$, and desirably includes at least about $20^6$ droplets per $cm^3$. The droplets 70 desirably constitute about 1% by volume of the mist.

The droplets 70 constituting the surrounding mist should be less than about 30 micrometers in diameter and desirably between about 5 and about 15 micrometers in diameter. Droplet sizes of this order can be produced readily by condensation from the vapor phase as described above. The amount of liquid which must be converted to droplets will vary with conditions such as the presence or absence of convection currents carrying droplets away from the vicinity of the stream and the degree of electrical insulation required. Typically, however, about one tenth of one percent or more of the liquid discharged as stream 64 should be converted to vapor and hence to droplets 70.

In the system described above, the major portion of the liquid supplied to porous element 44 is supplied through passageway 54. Some additional liquid may be provided to the porous element by stray droplets from the principal stream 64. Such stray droplets tend to collect on the front surface of wall 16 in the vicinity of orifice 18. The porous element 44 will tend to take up such stray droplets by a wicking action and transport the liquid in such stray droplets to heating wire 48 for conversion into vapor and hence into mist droplets 70. The amount of such stray droplets reaching porous element 44 will depend on factors such as the precise configuration of orifice 18 and the relationship between orifice diameter and the diameter of inner opening 46 in the porous ring 44. Where such stray droplet impingement on the porous element provides an adequate liquid supply to the porous element, passageway 54 may be omitted or closed. Moreover, the wicking action of porous element 44 and removal of stray droplets from the vicinity of orifice 18 aids in maintaining reliable operation of the system. The porous element 44 serves to remove stray droplets which might otherwise accumulate on the downstream facing surface of wall 16 to the point where they impede discharge of the stream 64 and hence impede atomization.

Where the net change is applied to the liquid by electrodes as discussed above, the liquid desirably is substantially nonconductive. Thus, the liquid desirably has electrically conductivity less than about 10 mho/m, more desirably less than about $10^{-2}$ mho/m and most desirably less than about $10^{-4}$ mho/m. Still lower electrical conductivity is even more desirable. Many common liquids treated in industry, such as fuels, lubricants, and solvents have conductivities in this range. Organic liquids such as hydrocarbons and halogenated hydrocarbons are particularly well-suited to processing in accordance with the invention. As used in this disclosure, the terms "liquid" includes both pure liquids and dispersions such as suspensions of solids in a liquid dispense phase. Also, the term "liquid" should be understood as referring to substances which are liquid at the inception of atomization. Thus, the liquid may solidify upon atomization, either by cooling and phase change or by chemical reaction occurring within the liquid concomitantly with atomization.

In a variant of the method discussed above, the vapor generated by operation of heating element 48 does not condense appreciably in the region surrounding the stream. Although there may be some condensation at the interface of the vapor and the stream, there is no appreciable mist. This may occur, for example, where the liquid to be atomized has a relatively high vapor pressure at the temperature prevailing in the surrounding atmosphere. In this case, the region surrounding the stream is filled with the vapor or with a mixture of vapor and surrounding atmospheric gas rather than with a mist of droplets 70. The proportion of vapor and surrounding atmospheric gas in such mixture is controlled by the geometry of the system, the rate of gas flow around the stream and the rate of vapor formation at heating element 48. The rate of vapor formation in turn will depend upon the rate of heat evolution at element 48. Most desirably in this variant, the gas surrounding the stream 64 consists essentially of pure vapor. However, the rate of heat evolution at element 48 should not be so high as to raise the temperature of the vapors surrounding stream 64 substantially above the temperature of the surrounding atmosphere. The vapors generally provide greater dielectric breakdown strength at lower temperatures.

Figure 3:
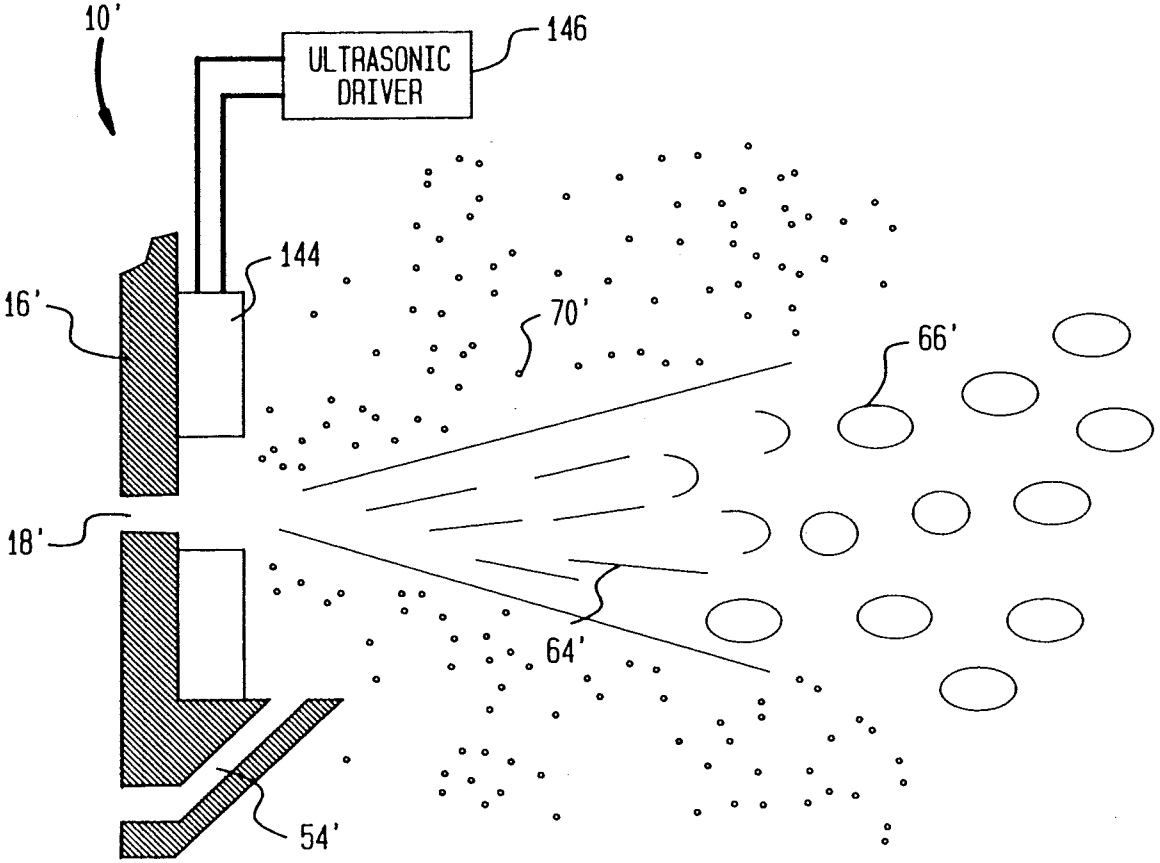
FIG. 3 is a fragmentary diagrammatic view of apparatus in accordance with a further embodiment of the invention.

An atomizing device in accordance with a further embodiment of the invention, as partially illustrated in FIG. 3, includes a body 10' having a forward wall 16' defining an orifice 18' substantially in accordance with the embodiment discussed above with reference to FIGS. 1 and 2. This embodiment includes similar components (not shown) for supplying the liquid and forcing the liquid through the orifice 18' so as to discharge at least the major portion of the liquid as a stream 64' through orifice 18. Also, this apparatus incorporates components (not shown) similar to those discussed above for imposing a net charge on the liquid issuing as stream 64', so that the stream bears a net charge and is atomized to form droplets 66' at least partially under the influence of that net charge. In the embodiment of FIG. 3, however, the porous element and heating wire discussed above are replaced by a ringlike piezoelectric element 144 mounted on the front wall 16' of the body and surrounding orifice 18'. Piezoelectric element 144 is electrically connected to an ultrasonic driver 146 arranged to apply electrical energy to the piezoelectric element as a voltage varying at ultrasonic frequencies, i.e., at about 30 KHZ or more. As in the embodiment discussed above, a passageway 54' leads to the interior chamber of the body so as to divert a minor portion of the liquid to be atomized onto element 144. Upon application of the varying voltage by driver 146, electric element 144 undergoes mechanical vibrations at the frequency of the applied voltage. The vibrating element 144 mechanically disperses the liquid applied through passageway 54' into fine mist droplets 70' thus forming an insulating mist around stream 64'. Here again, the mist should extend downstream from the orifice to the region where the stream 64, breaks up into droplets 66', i.e., about 1 centimeter/about 2 cm. Also, in this embodiment as well, the liquid utilized to form the mist droplets 70 may be derived in whole or in part from stray droplets from the main stream 64', in which case passageway 54' may be omitted.

As will be appreciated from the foregoing description of the preferred embodiments, numerous variations and combinations of the features discussed above may be employed. For example, in the preferred embodiments discussed above, the mist of droplets 70 or 70' entirely surrounds the stream in the region immediately downstream of the orifice 18'. However, the mist need not entirely surround the stream in order to effectively isolate the stream from the surroundings in all cases. Where the stream is discharged adjacent a dielectric wall or surface extending parallel to the upstream to downstream direction of the stream, so that the wall overlies one side of the stream, the dielectric mist may be provided only on the side of the stream opposite from the wall. Also, the mist employed to isolate the stream from the surroundings may be created by means other than the heating and piezoelectric elements discussed above. Thus, other liquid atomization techniques may be utilized to form the mist. The mist-forming atomization may be conducted by discharging a minor portion of the liquid through one or more very small orifices; by mixing droplets of the liquid with the surrounding gas and then subjecting this mixture to sonic vibrations and/or shock waves and by any other conventional atomization technique. Indeed, it is possible to provide a small charge injection apparatus similar to the main apparatus to form the insulating mist droplets. Any such auxiliary charge injection apparatus would be operated at a somewhat lower potential than the principal apparatus so that the stream in the auxiliary apparatus would not itself require a vapor mist insulation to preclude corona breakdown.

In the preferred embodiments discussed above, the mist is formed from a portion of the principal liquid to be atomized. As discussed above, this is greatly preferred because it avoids the need to introduce any extraneous material to the system for the purposes of insulation and corona suppression. However, it is possible to form an insulating mist from a separately supplied additional liquid. For example, the embodiment of FIG. 1 can be modified to use an additional liquid by disconnecting passageway 54 from chamber 14 and connecting it to a source (not shown) for a separate mist-forming liquid. As these and other variations and combinations of the features described above can be utilized without departing from the broadest encompass of the present invention, the foregoing descriptions of the preferred embodiments should be taken by way of illustration rather than by way of limitation of the invention as defined by the claims.

It should be further understood that the embodiments herein described are merely exemplary and that a person skilled in the art may make numerous variations and modifications without departing from the spirit and scope of the instant invention as defined by the appended claims.

What is claimed is:

1. A method of atomizing a liquid comprising the steps of (a) supplying a liquid;

(b) providing a net charge on said liquid so that said liquid is atomized at least partially under the influence of said net charge; and (c) supplying an insulating mist in juxtaposition with said charged liquid so as to insulate said charged liquid from the surroundings prior to said atomization.

2. The method of claim 1 wherein said step of supplying said insulating mist in juxtaposition with said charged liquid includes the step of atomizing a portion of said liquid to form said insulating mist.

3. The method of claim 2 wherein said step of providing said insulating mist includes the step of supplying heat to vaporize said portion of said liquid and cooling said vapor to form said mist portion.

4. The method of claim 2 wherein said step of providing said insulating mist includes the step of applying ultrasonic vibrations to said portion of said liquid.

5. The method of claim 1 wherein said step of supplying said liquid includes the step of discharging said liquid in a stream and said step of providing a net charge includes the step of providing a net charge on said liquid prior to formation of said stream.

6. The method of claim 5 wherein said step of supplying said insulating mist in juxtaposition with said charged liquid includes the step of atomizing a portion of said liquid to form said insulating mist.

7. The method of claim 6 wherein said step of supplying said insulating mist includes the step of surrounding said stream with said insulating mist.

8. The method of claim 7 wherein said step of supplying said liquid in said stream includes the step of projecting said liquid in a downstream direction from an orifice whereby said orifice is at the upstream end of said stream and said step of surrounding said stream with said insulating mist includes the step of providing said insulating mist so that said insulating mist surrounds said stream at an upstream portion thereof adjacent said orifice.

9. The method of claim 8 wherein said step of providing said mist is performed so that said mist surrounds said stream from said orifice to a point downstream from said orifice where said stream breaks into droplets.

10. Apparatus for atomizing a liquid comprising means for supplying said liquid;

means for providing a net charge on said liquid so that said liquid is atomized at least partially under the influence of said net charge; and means for supplying an insulating mist in juxtaposition with said charged liquid so as to insulate said charged liquid from the surroundings prior to said atomization.

11. Apparatus as claimed in claim 10 wherein said means for supplying said liquid includes a body having an orifice and means for discharging said liquid in a stream in a downstream direction from said orifice and said means for providing a net charge includes means for providing a charge on said liquid so that said liquid in said stream discharged from said orifice bears a net charge.

12. Apparatus as claimed in claim 11 wherein said means for supplying said insulating mist includes means for surrounding said stream with said insulating mist.

13. Apparatus as claimed in claim 12 wherein said means for providing said charge on said liquid includes means defining a first surface and a second surface within said body and means for establishing a potential difference between said first and second surfaces.

14. The method of claim 10 wherein said means for supplying said insulating mist includes means for forming said insulating mist from said liquid supplied by said means for supplying.

15. Apparatus as claimed in claim 14 wherein said means for supplying said insulating mist includes means for heating said liquid so as to vaporize said liquid so that said insulating mist will form by condensation of the vaporized liquid.

16. Apparatus as claimed in claim 15 wherein said means for supplying and insulating mist includes a porous element and a heating element in juxtaposition with said porous element.

17. Apparatus as claimed in claim 16 wherein said body has a downstream wall, said orifice extends through said downstream wall and said porous element is juxtaposed with said downstream wall so that stray liquid impinging on said downstream wall will be absorbed by said porous element.

18. Apparatus as claimed in claim 16 wherein said means for supplying said insulating mist includes means for applying ultrasonic vibrations to a portion of said liquid.

19. A method of atomizing a liquid comprising the steps of (a) supplying a liquid;

(b) providing a net charge on said liquid so that said liquid is atomized at least partially under the influence of said net charge; and (c) heating a portion of said liquid so as to form an insulating vapor juxtaposed with said charged liquid so as to insulate said charged liquid from the surroundings prior to said atomization.

20. The method of claim 19 wherein said step of supplying said liquid includes the step of discharging the major portion of said liquid in a stream and said step of providing a net charge includes the step of providing a net charge on said major portion of said liquid prior to formation of said stream, wherein said step of supplying said vapor includes the step of surrounding said stream with said vapor.

21. The method of claim 20 wherein said step of supplying said liquid in said stream includes the step of projecting said liquid in a downstream direction from an orifice whereby said orifice is at the upstream end of said stream and said step of surrounding said stream with said vapor includes the step of converting a minor portion of said liquid to vapor at a heating element surrounding said orifice, so that said vapor surrounds said stream at an upstream portion thereof adjacent said orifice.

22. The method of claim 21 wherein said step of providing said mist is performed so that said vapor surrounds said stream from said orifice to a point downstream from said orifice where said stream breaks into droplets.

23. Apparatus for atomizing a liquid comprising:

means for supplying said liquid;

means for providing a net charge on said liquid so that said liquid is atomized at least partially under the influence of said net charge; and means for heating a portion of said liquid to thereby form an insulating vapor and supplying said insulating vapor in juxtaposition with said charged liquid so as to insulate said charged liquid from the surroundings prior to said atomization.

24. Apparatus as claimed in claim 23 wherein said means for supplying said liquid includes a body having an orifice and means for discharging said liquid in a stream in a downstream direction from said orifice, said means for providing a net charge includes means for providing a charge on said liquid so that said liquid in said stream discharged from said orifice bears a net charge.

25. Apparatus as claimed in claim 24 wherein said means for heating a portion of said liquid includes a porous element surrounding said orifice and a heating element in juxtaposition with said porous element.

* * * * *

UNITED STATES PATENT AND TRADEMARK OFFICE

CERTIFICATE OF CORRECTION

PATENT NO. : 4,991,774

DATED : February 12, 1991

INVENTOR(S) : Kelly

It is certified that error appears in the above-identified patent and that said Letters Patent is hereby corrected as shown below:

Column 6, line 54, "change" should read --charge--.

Column 7, line 65, after "64" insert therefor --'--.

Signed and Sealed this

First Day of September, 1992

*Attest:*

DOUGLAS B. COMER

*Attesting Officer*

*Acting Commissioner of Patents and Trademarks*